US008960371B2

(12) United States Patent
Schoenauer et al.

(10) Patent No.: US 8,960,371 B2
(45) Date of Patent: Feb. 24, 2015

(54) GRAVITY DRIVEN START PHASE IN POWER LIMITED ELEVATOR RESCUE OPERATION

(75) Inventors: Uwe Schoenauer, Berlin (DE); Andreas Belkner, Berlin (DE)

(73) Assignee: Otis GmbH & Co. OHG (DE)

( * ) Notice: Subject to any disclaimer, the term of this patent is extended or adjusted under 35 U.S.C. 154(b) by 523 days.

(21) Appl. No.: 13/257,780

(22) PCT Filed: Jun. 30, 2009

(86) PCT No.: PCT/US2009/049215

§ 371 (c)(1),
(2), (4) Date: Sep. 20, 2011

(87) PCT Pub. No.: WO2011/002447

PCT Pub. Date: Jan. 6, 2011

(65) Prior Publication Data

US 2012/0085593 A1 Apr. 12, 2012

(51) Int. Cl.
*B66B 1/06* (2006.01)
*B66B 5/02* (2006.01)

(52) U.S. Cl.
CPC ..... *B66B 5/027* (2013.01)
USPC ..... 187/290; 187/391

(58) Field of Classification Search
USPC ..... 187/247, 248, 313, 284, 288–291, 296, 187/297, 391–393; 307/66, 68, 69
See application file for complete search history.

(56) References Cited

U.S. PATENT DOCUMENTS 3,144,917 A 8/1964 Tressel
4,376,471 A 3/1983 Uchino et al.
4,506,766 A 3/1985 Watanabe
4,642,474 A 2/1987 Watanabe
5,821,476 A 10/1998 Hakala et al.
6,161,656 A 12/2000 Horbrugger et al.
6,196,355 B1 3/2001 Fargo et al.
6,269,910 B1 8/2001 Fargo et al.
6,315,081 B1 11/2001 Yeo (Continued)

FOREIGN PATENT DOCUMENTS

CN 1351571 A 5/2002
EP 0733577 B1 9/2003

(Continued)

OTHER PUBLICATIONS

State Intellectual Property Office, P.R. China, First Office Action, Jul. 30, 2013, 6 pages.
State Intellectual Property Office, People's Republic China, Search Report, Jul. 22, 2013, 2 pages.
Patent Cooperation Treaty, International Searching Authority, International Search Report and Written Opinion, Jan. 21, 2010, 11 pages.
Japanese Patent Office, Office Action, Aug. 27, 2013, 5 pages.
European Search Report for EP application No. 09846936.4, Issued Dec. 12, 2014, 5 pages.

*Primary Examiner* — Anthony Salata
(74) *Attorney, Agent, or Firm* — Cantor Colburn LLP

(57) ABSTRACT

When main power to an elevator system 10 is lost, an automatic rescue operation is performed using power from a backup power source 46. A rescue run for an elevator stopped between floors is initiated by lifting a brake 28 and allowing the elevator car 12 to move by gravity. If the car 12 moves as a result of a weight imbalance between the car 12 and a counterweight 14, operation of the hoist motor 24 is synchronized with sensed movement of the car 12 to generate electricity. If weight is balanced so that the car 12 does not move, backup power is supplied to the hoist motor 24 to apply a motor torque to drive the car 12 in a selected direction during the rescue run.

15 Claims, 4 Drawing Sheets

(56) References Cited

U.S. PATENT DOCUMENTS

| | | | | |
|---|---|---|---|---|
| 6,435,312 | B2 | 8/2002 | Tajima et al. | |
| 6,471,013 | B2 | 10/2002 | Banno et al. | |
| 6,516,922 | B2 | 2/2003 | Shadkin et al. | |
| 7,549,515 | B2 * | 6/2009 | Tegtmeier et al. | 187/288 |
| 7,594,564 | B2 * | 9/2009 | Siikonen et al. | 187/384 |
| 7,681,693 | B2 * | 3/2010 | Tegtmeier et al. | 187/288 |
| 7,690,483 | B2 * | 4/2010 | Tegtmeier et al. | 187/394 |
| 8,172,042 | B2 * | 5/2012 | Wesson et al. | 187/382 |
| 8,230,978 | B2 * | 7/2012 | Agirman et al. | 187/290 |
| 8,631,908 | B2 * | 1/2014 | Schroeder-Brumloop et al. | 187/290 |
| 2002/0162705 | A1 | 11/2002 | Shadkin et al. | |
| 2007/0272492 | A1 | 11/2007 | Tegtmeier et al. | |
| 2008/0202859 | A1 | 8/2008 | Tegtmeier et al. | |

FOREIGN PATENT DOCUMENTS

| | | | |
|---|---|---|---|
| JP | 57151573 | | 9/1982 |
| JP | 08259139 | | 10/1996 |
| JP | 09208142 | A | 8/1997 |
| JP | 2000001276 | A | 1/2000 |
| JP | 2000219449 | A | 8/2000 |
| JP | 2009012929 | A | 1/2009 |

* cited by examiner

GRAVITY DRIVEN START PHASE IN POWER LIMITED ELEVATOR RESCUE OPERATION

BACKGROUND

When main power to an elevator system is lost, power to the elevator hoist motor and the emergency brake associated with an elevator car is interrupted. This causes the hoist motor to stop driving the car, and causes the emergency brake (which is disengaged when energized) to drop into engagement with the drive shaft. As a result, the car is stopped almost immediately. Because the stopping may occur randomly at any location within the elevator hoistway, passengers may be trapped in the elevator car between floors. In conventional systems, passengers trapped in an elevator car between floors may have to wait until a maintenance worker is able to release the brake and control cab movement upward or downward to allow the elevator car to move to the nearest floor. It may take some time before a maintenance worker arrives and is able to perform the rescue operation.

Elevator systems employing automatic rescue operations (ARO) have been developed. These elevator systems include a backup electrical power source that is controlled after a main power failure to provide backup power to move the elevator car to the next floor landing. Conventional automatic rescue operation systems typically use a battery as the backup emergency power source. They attempt to direct the rescue run into the "light" direction, i.e., the direction that gravity will tend to move the car as a result of weight difference between the car with its passengers and the counterweight. The automatic rescue system makes use of load weighing devices to determine the "light" direction. The hold current is applied to the hoist motor to apply a torque in a direction opposite to the load imbalance sensed by the load weighing device, so that the elevator car will not move while the brake is being lifted. Once the brake has been lifted, the system attempts to drive the car in the light direction, as indicated by signals from a load weighing device. The battery as well as the supply circuitry must be dimensioned to deliver a peak hold current for a maximum load in the car.

In some cases, the determination of the light direction may be difficult using load weighing devices. If the light direction is determined incorrectly because load weighing has failed, or the load weighing signals have been misinterpreted, an attempt could be made to drive the car in the heavy direction. This can result in larger peak currents and in increased energy consumption.

The automatic rescue operation system must account for an energy reserve, and require failure handling logic in case the load weighing has failed and a run is attempted into the "heavy" direction. The peak current and energy capacity required for the start phase, and for the failure scenario in which a run in the "heavy" direction is attempted, significantly exceed the requirements for moving a balanced load or for operating the elevator once the start phase has passed and the elevator is moving in the "light" direction.

SUMMARY

A power limited automatic rescue run is performed by lifting the brake without providing holding torque to the hoist motor. If a significant imbalance in weight exists between the car and a counterweight, gravity will cause the car to move into the light direction. The direction and speed of motion of the car is sensed. When the car is moving, the motor is activated and is synchronized to the ongoing motion of the car. The synchronized operation of the motor controls the rescue run until the car reaches its target position. If the car and the counterweight are balanced so that the car is not moving, backup power is supplied to the hoist motor to drive the car in a selected direction to a target destination.

DETAILED DESCRIPTION

Figure 1:
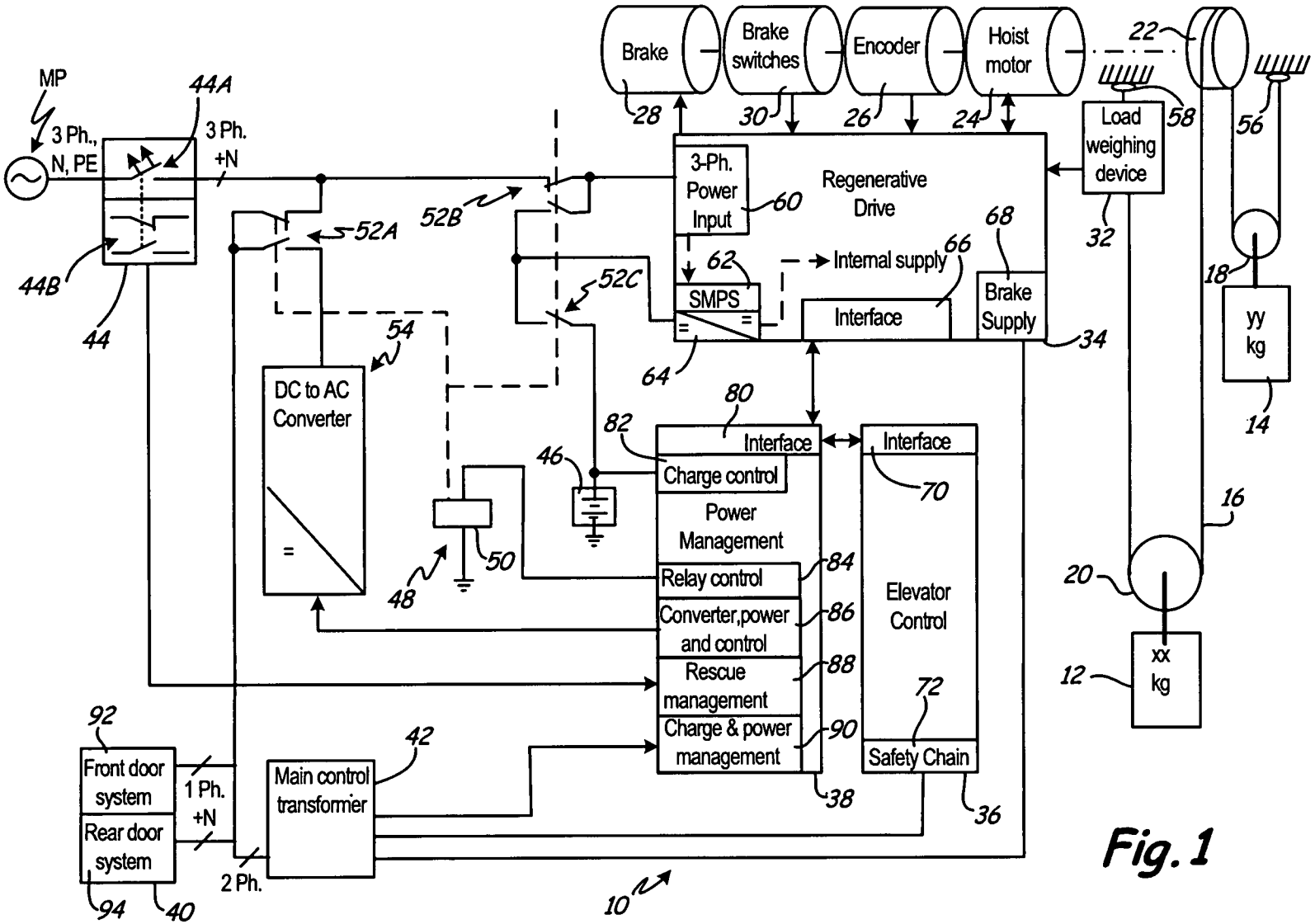
FIG. 1 is a block diagram of an elevator system that provides a gravity driven start phase for a power limited automatic rescue operation.

FIG. 1 is a block diagram of elevator system 10, which includes an automatic rescue operation function with a gravity driven start phase. Elevator system 10 includes elevator car 12, counterweight 14, roping 16, pulleys 18 and 20, drive sheave 22, hoist motor 24, encoder 26, brake 28, brake switches 30, load weighing device 32, regenerative drive 34, elevator control 36, power management system 38, door system 40, main control transformer 42, main circuit breaker 44, backup power source 46, relay 48 (including relay coil 50 and relay contacts 52A, 52B, and 52C), and DC-to-AC converter 54.

In the diagram shown in FIG. 1, car 12 and counterweight 14 are suspended from roping 16 in a 2:1 roping configuration. Roping 16 extends from fixed attachment 56 downward to pulley 18, then upward over sheave 22, downward to pulley 20, and upward to load weighing device 32 and fixed attachment 58. Other roping arrangements may be used, including 1:1, 4:1, 8:1, and others.

Elevator car 12 is driven upward, and counterweight 14 is driven downward, when sheave 22 rotates in one direction. Car 12 is driven downward and counterweight 14 is driven upward when sheave 22 rotates in the opposite direction. Counterweight 14 is selected to be approximately equal to the weight of elevator car 12 together with an average number of passengers. Load weighing device 32 is connected to roping 16 to provide an indication of the total weight of car 12 and its passengers. Load weighing device 32 may be located in a variety of different locations, such as a dead end hinge, on roping 16, on top of car 12, underneath the car platform of car 12, etc. Load weighing device 32 provides the sensed load weight to regenerative drive 34.

Drive sheave 22 is connected to hoist motor 24, which controls the speed and direction of movement of elevator car 12. Hoist motor 24 is, for example, a permanent magnet synchronous machine, which may operate as either a motor or as a generator. When operating as a motor, hoist motor 24 receives three-phase AC output power from regenerative drive 34 to cause rotation of drive sheave 22. The direction of rotation of hoist motor 24 depends on the phase relationship of the three AC power phases. When hoist motor 24 is operating as a generator, drive sheave 22 rotates hoist motor 24 and causes AC power to be delivered from hoist motor 24 to regenerative drive 34.

Encoder 26 and brake 28 are also mounted on the shaft of hoist motor 24. Encoder 26 provides encoder signals to regenerative drive 34 to allow regenerative drive 34 to synchronize pulses applied to hoist motor 24 to either operate hoist motor 24 as a motor or as a generator.

Brake 28 prevents rotation of motor 24 and drive sheave 22. Brake 28 is an electrically actuated brake that is lifted or maintained out of contact with the motor shaft when power is delivered to brake 28 by regenerative drive 34. When power is removed from brake 28, it drops or engages the shaft of hoist motor 24 (or an attachment to the shaft) to prevent rotation. Brake switches 30 or other sensing devices (e.g. optical, ultrasonic, hall-effect, brake current sensors) monitor the state of brake 28, and provide inputs to regenerative drive 34.

The power required to drive hoist motor 24 varies with acceleration and direction of movement of elevator car 12, as well as the load in elevator car 12. For example, if elevator car 12 is being accelerated, or run upward with a load greater than the weight of counterweight 14, or is run downward with a load that is less than the weight of counterweight 14, power from regenerative drive 34 is required to drive hoist motor 24, which in turn rotates drive sheave 22. If elevator car 12 is leveling, or running at a fixed speed with a balanced load, a lesser amount of power may be required by hoist motor 24 from regenerative drive 34. If elevator car 12 is decelerated, or is running downward with a load that is greater than counterweight 14, or is running upward with a load that is less than counterweight 14, elevator car 12 drives sheave 22 and hoist motor 24. In that case, hoist motor 24 operates as a generator to generate three-phase AC power that is supplied to regenerative drive 34.

Under normal operating conditions, regenerative drive 34 receives three-phase AC power from main power supply MP, such as a power utility grid. The three-phase AC power is supplied to regenerative drive 34 through main contacts 44A of main circuit breaker 44, and through relay contacts 52B.

Regenerative drive 34 includes three-phase power input 60, switched-mode power supply (SMPS) 62, DC-to-DC converter 64, interface 66, and brake supply 68. Three-phase power from main power supply MP is received by three-phase power input 60 and delivered to SMPS 62. Three-phase input power is rectified to provide DC power on a DC bus. The DC power is inverted to produce AC power for driving hoist motor 24. DC converter 64 operates during a loss of the three-phase power to provide backup DC power to the DC bus of SMPS 62. DC-to-DC converter 64 receives power from backup power source 46 through relay contacts 52 when a rescue operation is to be performed, and converts the voltage from backup power supply 46 to the voltage level required on the DC bus of SMPS 62.

Brake supply 68 of regenerative drive 34 receives power from main control transformer 42 (or alternatively from another source such as SMPS 62) to control operation of brake 28. Regenerative drive 34 communicates with power management system 38 and elevator control 36 through interface 66. Elevator control 36 provides control inputs to regenerative drive 34 to control the movement of elevator car 12 within the hoistway. The control inputs may include commands instructing regenerative drive 34 on when and in what direction to drive elevator 12, as well as commands indicating when to lift brake 28 to allow movement of car 12, and when to drop brake 28 to halt movement of elevator car 12. Regenerative drive 34 receives control inputs from power management system 38 to coordinate an automatic rescue operation using power from backup power supply 46.

Elevator control 36 controls the movement of elevator car 12 within the hoistway. As shown in FIG. 1, elevator control 36 includes interface 70 and safety chain 72. Elevator control 36 communicates with regenerative drive 34 and power management system 38 through interface 70. Safety chain 72 is used to prevent movement of car 12 in the hoistway during potentially unsafe conditions. Safety chain 72 may include switch contacts associated with the operation of hoistway doors, as well as other sensors that indicate conditions under which elevator car 12 should not be moved. When any of the sensing contacts are open, safety chain 72 is broken, and elevator control 36 inhibits operation until safety chain 72 is again closed. Elevator control 36 may, as part of a break in safety chain 72, provide a control input to regenerative drive 34 to cause brake 28 to drop.

Elevator control 36 also receives inputs based upon user commands received through hall call buttons or through input devices on the control panel within elevator car 12. Elevator control 36 (or regenerative drive 34) determines direction in which elevator car 12 should move and the floors at which elevator car 12 should stop.

Power management system 38 includes interface 80, charge control 82, relay control 84, converter power control 86, rescue management 88, and charge and power management input 90. Interface 80 allows power management system 38 to communicate with both elevator control 36 and regenerative drive 34. The function of power management system 38, in conjunction with regenerative drive 34 and elevator control 36, is to provide automatic rescue operation of elevator system 10 using power from backup power source 46 when three-phase power from the main power supply has been lost.

Charge control input 82 of power management system 38 monitors the voltage on backup power supply 46. Rescue management input 88 monitors the state of main circuit breaker 44, by monitoring the state of auxiliary contacts 44B. Charge and power management input 90 allows power management system 38 to monitor power from main control transformer 42, which provides an indication of whether power is being delivered to door system 40 and main control transformer 42 through relay contacts 52A.

Interface 80 of power management system 38 provides a control input to interface 66 of regenerative drive 34 when power management system 38 determines that an automatic rescue operation is to be performed. The control input causes regenerative drive 34 to convert power from backup power source 46 using DC-to-DC converter 64.

Relay control 84 controls the state of relay 48 by selectively providing power to relay coil 50. When relay coil 50 is energized by relay control 84, relay contacts 52A, 52B, and 52C change from a first state used during normal operation of elevator system 10 to a second state used for automatic rescue operation. In FIG. 1, relay contacts 52A-52C are shown in the first state associated with normal operation of elevator system 10.

During automatic rescue operation, converter power and control output 86 of power management system 38 actives DC-to-AC converter 54. Power is supplied from backup power source 46 through charge control input 82 and converter power and control output 86 to the DC input of DC-to-AC converter 54.

Door system 40, which may include front door system 92 and rear door system 94 opens and closes the elevator and hoistway doors when elevator car 12 is at a landing. Door system 40 uses single phase AC power that is received from main power supply MP during normal operations, or from DC-to-AC converter 54 during automatic rescue operation.

Main control transformer 42 provides power to elevator control 36 through safety chain 72. It also provides power to power management system 38 through charge and power management input 90. It provides power to charge backup power supply 46 through charge and power management input 90 and charge control 82. Regenerative drive 36 is supplied through contacts 52B and input 60 during normal mains operation and by backup power source 46 through contacts 52C into power input 60 and DC-to-DC converter 64. Main control transformer 42 uses two of the three phases of electrical power provided from main power supply MP during normal operation. During automatic rescue operation, main control transformer 42 receives two phases of AC power from AC-to-DC converter 54.

During normal operation, power for operating elevator system 10 is provided by main power supply MP. The three-phase AC power flows through main circuit breaker 44 because main contacts 44A are closed. Power is supplied through relay contacts 52A to door system 40 and to main control transformer 42. Three-phase power is also delivered through relay contacts 52B to three-phase power input 60 of regenerative drive 34. Power to operate elevator control 36, power management 38, and the brake system of regenerative drive 34 is produced by main control transformer 42 based upon the power received through relay contacts 52A. Based upon inputs received by elevator control 36, regenerative drive 34 is operated to move elevator car 12 within the hoistway in order to rescue the passengers.

During normal operation, power management system 38 monitors the state of main circuit breaker 44 through auxiliary contacts 44B. Auxiliary contacts 44B allow power management system 38 to verify that main circuit breaker 44A is closed. If power from main control transformer 42 is also present, power management system 38 determines that normal operation is taking place, and backup power source 46 is not needed.

If main circuit breaker 44 opens, it changes state of auxiliary contacts 44B occurs. This signals to power management system 38 that main circuit breaker 44 is open. Normally this indicates that a service technician has disabled elevator system 10. Under those circumstances, although AC power is no longer available to regenerative drive 34, automatic rescue operation is not needed.

When main circuit breaker 44 is closed, but power is no longer available from main control transformer 42, power management system 38 initiates automatic rescue operation. Relay control 84 energizes relay coil 50, which causes contacts 52A, 52B, and 52C to change state. During automatic rescue operation, contacts 52A disconnect main power supply MP from door system 40 and main control transformer 42. Instead, DC-to-AC converter 54 is connected through relay contacts 52A to door system 40 and main control transformer 42.

Relay contacts 52B change state so that main power supply MP is disconnected from three-phase power input 60 of regenerative drive 34. Contacts 52C close during automatic rescue operation, so that backup power supply 46 is connected to the input of DC-to-DC converter 64 and to three-phase power input 60.

During automatic rescue operation, backup power supply 46 provides power used by regenerative drive 34 to move elevator car 12 to a landing where passengers may exit elevator car 12. In addition, power from backup power supply 46 is converted to AC power by DC-to-AC converter 54 and is used to provide power to door system 40 and main power control transformer 42. Power from main control transformer 42 during automatic rescue operation is used to power elevator control 36, and to provide power to brake supply 68 for use in controlling operation of brake 28.

When main power to elevator system 10 is lost, power to regenerative drive 34 is interrupted. This causes hoist motor 24 to stop driving elevator car 12. The loss of power also causes brake 28 to drop, so that movement of elevator car 12 stops almost immediately. Because the loss of power occurs randomly, car 12 may be stopped between floors, with passengers trapped within car 12.

The automatic rescue operation provided by elevator system 10 allows car 12 to be moved to a nearby floor, so that passengers may exit. Automatic rescue operation can be accomplished without having to wait for a maintenance worker to release the brake and control movement of car 12 to a near by floor. Power for automatic rescue operation is provided by backup power supply 46, which is typically a battery. For example, backup power supply 46 may be a 48 volt battery. The amount of power consumed in performing the automatic rescue operation affects the size and cost of the battery used for backup power supply 46. The factors include the amount of charge required stored in the battery, as well as the maximum current demand on the battery during an automatic rescue operation. Reducing the total charge required and reducing the maximum current requirements in the battery significantly reduce both size and cost of the battery.

In most cases in which main power is lost and car 12 is trapped between floors, there will be a load unbalance between total car weight (the weight of car 12 plus its passengers) and counterweight 14. If counterweight 14 is heavier, movement of car 12 upward is the "light" direction which will require less electrical power, and downward will be the heavy direction which requires a greater amount of power. Conversely, if the total car weight is greater than counterweight 14, movement of car 12 downward is the light direction and movement upward is the heavy direction.

A power-limited (i.e. battery supplied) automatic rescue operation is started by lifting brake 28 without providing holding torque to hoist motor 24. If there is a significant load imbalance between car 12 and counterweight 14, gravity will cause car 12 to move in the light direction. The direction and speed of motion can be identified using signals from encoder 26. When a desired, still low speed level is reached where hoist motor 24 can operate in a generator mode, the motor drive circuitry of SMPS 62 is activated. The drive to hoist motor 24 is synchronized to the ongoing motion based upon the encoder signals, which provide motor speed and rotor position information. Operation of hoist motor 24 is synchronized to the ongoing motion of car 12 and controls the rescue run until car 12 reaches the target position. To mitigate deceleration currents, brake 28 can be used slow and stop movement of car 12 to the target position.

Figure 2:
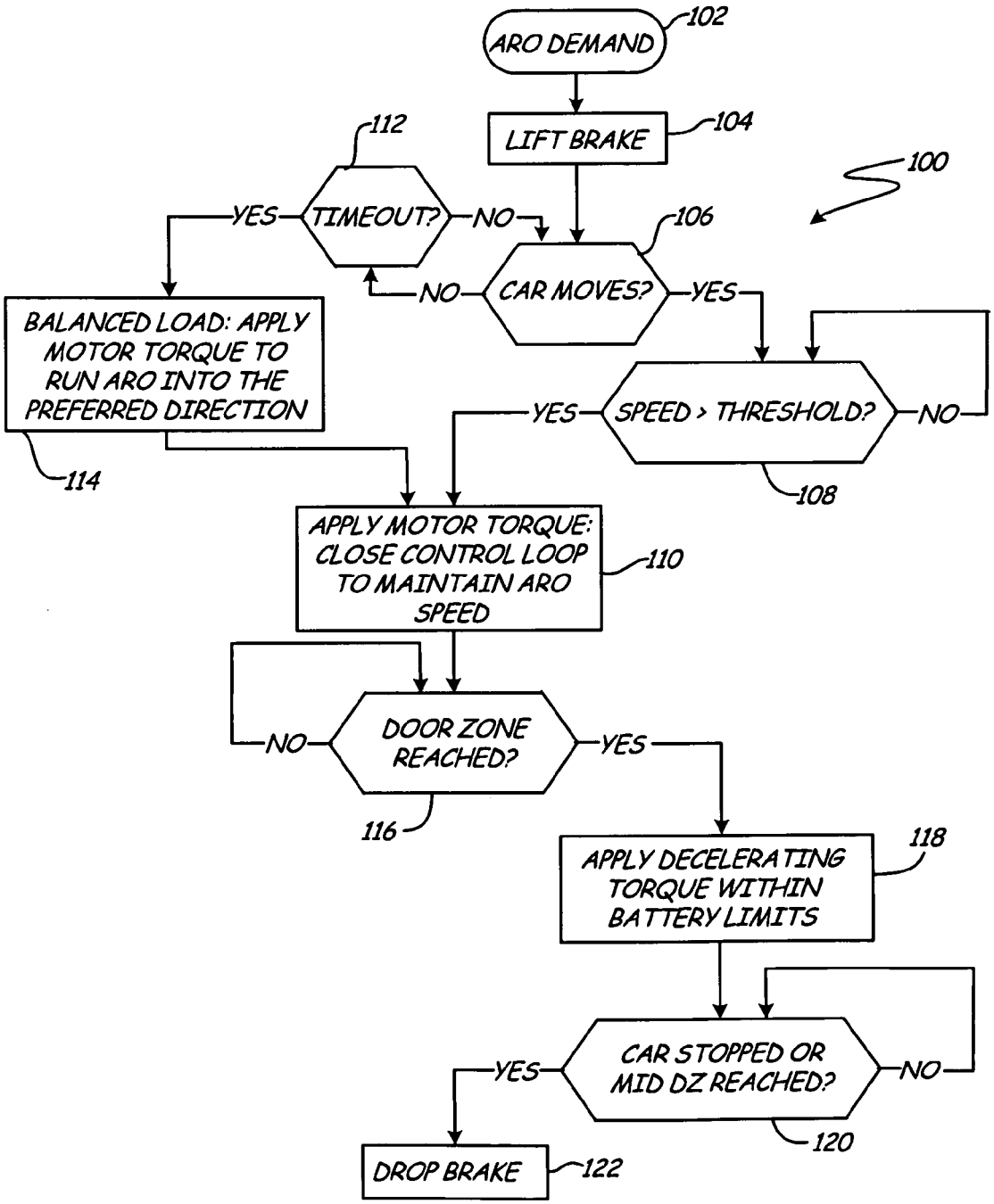
FIG. 2 is a flow chart illustrating automatic rescue operation in the system of FIG. 1.

FIG. 2 is a flow diagram showing operation of the automatic rescue operation. ARO operation 100 begins when power management system 38 determines that AC power has been lost (e.g. by detecting loss of power from main control transformer 42) and that main circuit breaker 44 is still closed. Power management system 38 receives an ARO demand which is provided to regenerative drive 34. Power management system 38 also controls relay 48, so that power is supplied from backup power source 46, rather than main power supply MP.

In response to the ARO demand, regenerative drive 34 lifts brake 28 (step 104). Power for lifting brake 28 is provided to regenerative drive 34 by main control transformer 42, which is now receiving AC power from DC-to-AC converter 54.

Regenerative drive 34 monitors encoder signals from encoder 34 to determine whether car 12 is moving (step 106). If the encoder signals indicate that the car is moving, regenerative drive 38 determines from the encoder signals the speed of a car movement, and compares that speed to a threshold speed (step 108). If the sensed speed is less than the threshold for operating motor 24 as a generator, regenerative drive 34 does not apply current to hoist motor 24 to produce motor torque. Instead, regenerative drive 34 continues to monitor speed and compare it to the threshold until the speed exceeds the threshold at which hoist motor 24 will be in an operational mode where the power supplied to or generated by hoist motor 24 is sufficiently low.

When the speed of the car as sensed by encoder 26 exceeds the generation threshold, regenerative drive 34 applies motor torque by synchronizing the stator drive pulses to hoist motor 24. The synchronization is achieved using the encoder signals from encoder 26, which indicate the speed and position of the rotor of hoist motor 24. Regenerative drive 34 closes the control loop to maintain the speed of car 12 within a desired range during the automatic rescue operation (step 110).

If car movement is not sensed at step 106 after lift brake 28 has been lifted (step 104), regenerative drive 34 determines whether a timeout period has passed (step 112). Regenerative drive 34 continues to monitor car movement until the timeout period has passed. Once the timeout period has passed without the speed reaching the threshold, regenerative drive 34 determines that a balanced load condition exists (step 114). Regenerative drive 34 then applies motor torque so that an automatic rescue operation run is made in a preferred direction, as identified by elevator control 36. The preferred direction may, for example, be to the nearest floor, or may be to a floor having access to emergency exits. Once regenerative drive 34 begins to apply motor torque at step 114, it proceeds to step 110 where speed car 12 during automatic rescue operation is maintained.

Elevator control 36 monitor's door zone sensors to determine whether a door zone has been reached (step 116). When a door zone has been reached, elevator control 36 signals regenerative drive 34, which applies decelerating torque through hoist motor 24. The decelerating torque is applied within battery limits defined for backup power supply 46 (step 118).

Regenerative drive 34 monitors encoder signals to determine whether car 12 has stopped, and elevator control 36 monitors door zone sensors to determine whether mid door zone has been reached in car 12 (step 120). When car 12 has stopped or the mid door zone has been reached, regenerative drive 34 drops brake 28 (step 122).

The automatic rescue operation in a gravity-driven start phase (or "free-rolling start") saves cost and space associated with backup power supply 46. It reduces peak supply current requirements, as well as energy storage requirements for backup supply 46. Savings can be gained both from backup power supply 46, as well as from the ARO circuitry (e.g. relay 48 and DC-to-AC converter 54). The use of a free-rolling start avoids erroneous attempts to run in the heavy direction in the event of a failure or malfunction of load weighing device 32.

Figure 3:
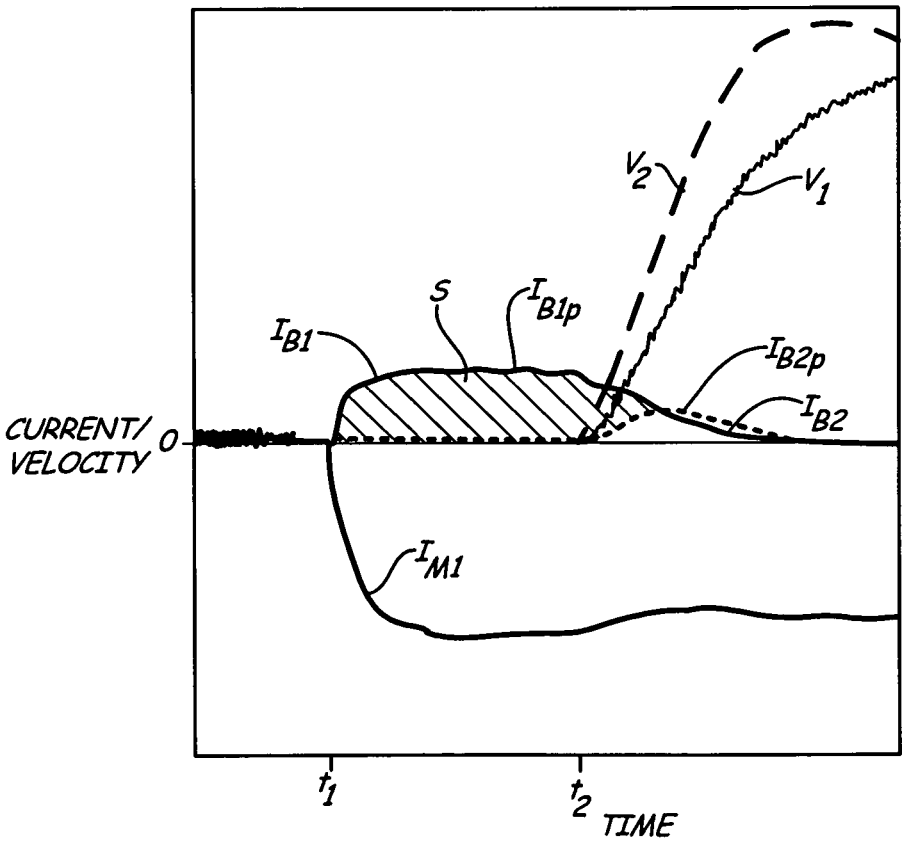
FIG. 3 is a graph illustrating battery current, motor current, and car velocity for a conventional automatic rescue operation run and for a rescue run with the automatic rescue operation illustrated in FIG. 2.

FIG. 3 is a graph comparing operation of a "conventional start" of an ARO run that involves applying holding current during brake lift with the "free-rolling start" of ARO run. The conventional start is illustrated by battery current $I_{B1}$, motor current $I_{M1}$, and velocity $V_1$. The free-rolling start ARO run is illustrated by battery current $I_{B2}$ and velocity $V_2$.

In the conventional start to an ARO run, an estimate is made of what the load will be based upon signals from the load weighing device. Based on that information, load motor is pretorqued while the brake is still dropped. Battery current $I_{B1}$ goes positive, while motor current $I_{M1}$ goes negative. Velocity $V_1$ is zero, since brake is still dropped in this time period.

Between time $t_1$ and time $t_2$, the brake has lifted. Velocity $V_1$ begins to increase from zero at about time $t_2$. At that same time, battery current $I_{B1}$ begins to decrease, and magnitude of current $I_{M1}$ also decreases (becomes less negative). As the hoist motor begins to be driven as a generator, the battery current $I_{B1}$ decreases to zero.

With the free-rolling start of the invention, battery current and motor current are not used to apply a holding torque. Instead, brake 28 is lifted and car 12 begins to move in the light direction, assuming that load unbalance between car 12 and counterweight 14. Velocity $V_2$ begins to increase at about time $t_2$, which is the point at which brake 28 is lifted and car 12 is free to move. Assuming that car 12 moves and reaches the threshold velocity, battery current $I_{B2}$ is supplied in order to operate hoist motor 24 as a generator. The peak current of $I_{B2}$, however, is significantly less than the peak current of $I_{B1}$. In addition, current $I_{B2}$ begins to decrease as hoist motor 24 acts as a generator to provide regenerated energy back to the DC bus of SMPS 62.

Shaded area S in FIG. 3 represents battery capacity savings that sheaves using the free-rolling start ARO system of the invention. The shaded area represents the difference in charge delivered by the battery in the conventional start versus the charge delivered by the battery in the free-rolling start.

The difference between peak current $I_{B1p}$ and peak current $I_{B2p}$ represents the battery current peak reduction achieved with the invention. By reducing both battery capacity required and peak current required, savings in size and class of backup power supply 46 can be achieved.

Figure 4:
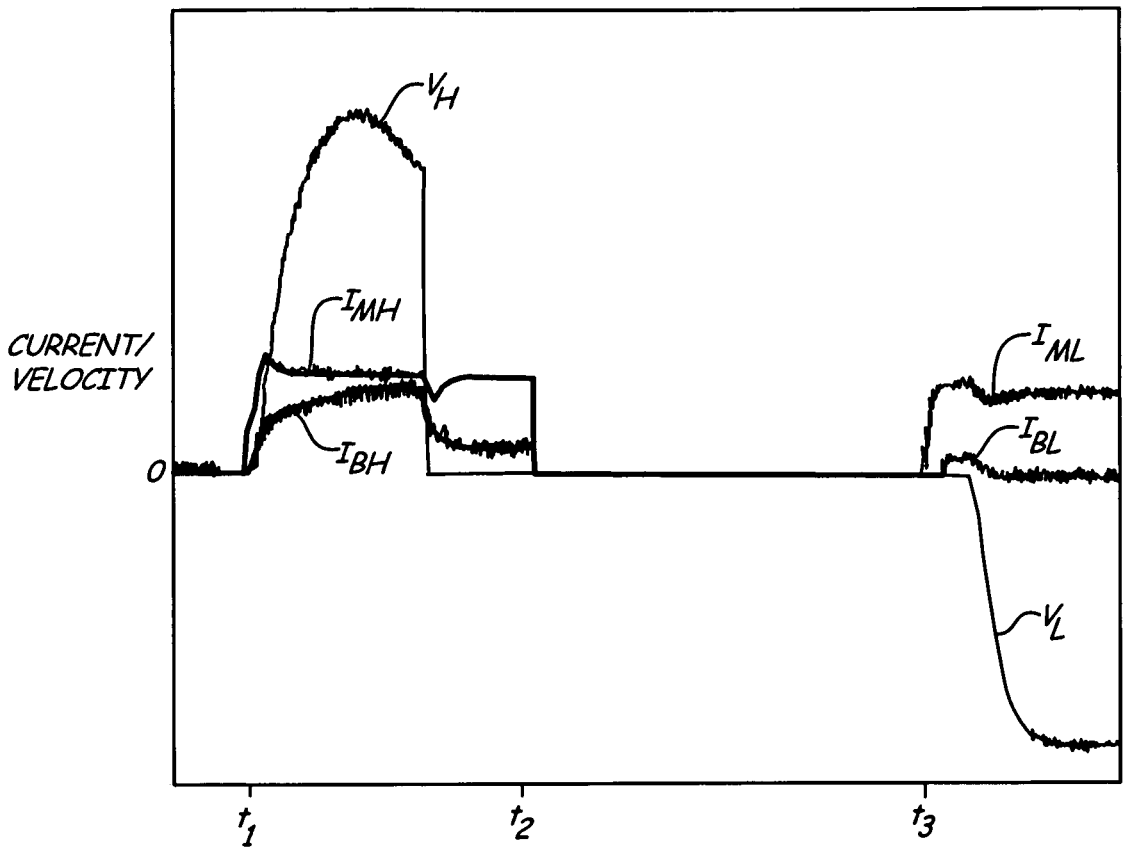
FIG. 4 is a graph showing velocity, motor current, battery current and voltage bus feedback for a conventional automatic rescue operation system in which a rescue run is initially started into the "heavy" direction, followed by a start in the "light" direction.

FIG. 4 shows the effects of a conventional start of an automatic rescue operation when system erroneously attempts a rescue run in the heavy direction rather than the light direction. In FIG. 4, the system initially attempts a run in the heavy direction, followed by a start in the light direction. Velocity $V_H$, motor current $I_{MH}$, and battery current $I_{BH}$ for the start in the heavy direction are shown in the time interval between time $t_1$ and time $t_2$. The subsequent start in the light direction begins at time $t_3$. Velocity $V_L$, motor current $I_{ML}$, and battery current $I_{BL}$ are shown. A comparison of battery current $I_{BH}$ and the start in the heavy direction with battery current $I_{BL}$ for the start in the light direction shows significant waste of energy that can occur if an ARO run is attempted erroneously in the heavy direction. This can occur with a conventional start ARO system, for example, as a result of a malfunction of load weighing device, or as a result of ambiguous readings from the load weighing device.

The free-rolling start ARO avoids situations in which a start is attempted in the heavy direction. By releasing the brake and allowing car 12 and counterweight 14 to move as a result of gravity, and then sensing the direction and speed of movement, the ARO system of the invention does not rely on proper functioning of load weighing device 32 to determine the direction of movement. As a result, erroneous attempts to drive car 12 in the heavy direction are avoided.

In the embodiment described above, encoder 26 is used to sense movement of car 12 and to provide signals used to synchronize operation of hoist motor 24 with movement of car 12. In other embodiments, motion of car 12 can be sensed by an indirect method from hoist motor 24 itself (e.g. by observing back EMF or inductance variations to determine rotor position) or by using sensors of car position independent of motor 24 (such as mechanical, ultrasonic, laser or other optical based sensors). The sensing produces a signal (or signals) to allow the system to observe motion of car 12.

Although the present invention has been described with reference to preferred embodiments, workers skilled in the art will recognize that changes may be made in form and detail without departing from the spirit and scope of the invention.

The invention claimed is:

1. A method of performing an elevator rescue run using power from a backup power source when main power is interrupted, the method comprising:

holding an elevator car in position with a brake;

initiating a rescue run by lifting the brake to allow the car to move by gravity;

sensing movement of the car;

if the car is not moving, supplying backup power to the motor to apply motor torque to drive the car in a selected direction during the rescue run; and if the car is moving, supplying backup power to the motor to produce a motor torque synchronized with sensed movement of the car during the rescue run in a direction of sensed movement;

wherein the motor torque synchronized with sensed movement of the car is supplied when the car reaches a speed at which the motor will be in an operational condition where power supplied to or generated by the motor is low.

2. The method of claim 1, wherein sensing movement of the car comprises generating a signal as a function of rotation of a rotor of the hoist motor.

3. The method of claim 2, wherein synchronizing operation of the motor includes applying stator drive pulses to the hoist motor.

4. The method of claim 3, wherein applying stator drive pulses is synchronized with rotation of the rotor.

5. The method of claim 1, and further comprising:

determining when the car reaches a door zone; and applying a decelerating motor torque to slow movement of the car.

6. The method of claim 1 and further comprising:

controlling the motor torque to maintain speed during the rescue run within a desired range.

7. A method of performing an elevator rescue run using power from a backup power source when main power is interrupted, the method comprising:

holding an elevator car in position with a brake;

initiating a rescue run by lifting the brake to allow the car to move by gravity;

sensing movement of the car;

if the car is not moving, supplying backup power to the motor to apply motor torque to drive the car in a selected direction during the rescue run;

if the car is moving, supplying backup power to the motor to produce a motor torque synchronized with sensed movement of the car during the rescue run in a direction of sensed movement;

determining when the car reaches a door zone;

applying a decelerating motor torque to slow movement of the car; and dropping the brake when the car stops or reaches a mid door zone position.

8. An elevator system comprising:

an elevator car;

a counterweight;

a sheave;

roping suspending the car and the counterweight and extending over the sheave;

a hoist motor having a shaft connected to the sheave;

a sensor for providing a signal representative of motion of the elevator car;

a brake for preventing rotation of the shaft;

a power management system for detecting when main power is lost and providing backup power;

a drive for controlling operation of the hoist motor;

wherein the drive, in response to a loss of main power, initiates an automatic rescue run by lifting the brake to allow the elevator car to move by gravity, applies motor torque to operate the hoist motor as a generator while the elevator car moves by gravity during the rescue run, and applies motor torque to operate the hoist motor as a motor to drive the elevator car if the elevator car is unable to move by gravity during the rescue run;

wherein the drive applies a decelerating motor torque to slow movement of the elevator care when the elevator car reaches a door zone;

wherein the drive drops the brake when the car stops or reaches a mid door zone position.

9. The elevator system of claim 8, wherein the drive causes the motor torque to be synchronized with sensed motion of the car as the car moves by gravity during the rescue run.

10. The elevator system of claim 8, wherein the drive controls the motor torque to maintain speed during the rescue run within a desired range.

11. A method of performing an elevator rescue run, the method comprising:

sensing an interruption of main power that has caused an elevator car to be held in position with a brake;

initiating a rescue run by lifting the brake to allow the car to move by gravity;

sensing movement of the car;

if the car does not move by gravity, supplying backup power from a backup power source to the motor to apply motor torque to drive the car in a selected direction during the rescue run; and if the car is moves by gravity, supplying backup power to the motor to produce a motor torque synchronized with sensed movement of the car during the rescue run in a direction of sensed movement;

wherein sensing movement of the car comprises generating signals as a function of rotation of a rotor of the hoist motor;

wherein producing motor torque synchronized with sensed movement of the car includes applying stator drive pulses to the hoist motor to cause the motor to operate as a generator.

12. The method of claim 11, wherein applying stator drive pulses is synchronized with rotation of the rotor.

13. The method of claim 11, and further comprising:

determining when the car reaches a door zone; and applying a decelerating motor torque to slow movement of the car.

14. The method of claim 11 and further comprising:

controlling the motor torque to maintain speed during the rescue run within a desired range.

15. A method of performing an elevator rescue run, the method comprising:

sensing an interruption of main power that has caused an elevator car to be held in position with a brake;

initiating a rescue run by lifting the brake to allow the car to move by gravity;

sensing movement of the car;

if the car does not move by gravity, supplying backup power from a backup power source to the motor to apply motor torque to drive the car in a selected direction during the rescue run;

if the car is moves by gravity, supplying backup power to the motor to produce a motor torque synchronized with sensed movement of the car during the rescue run in a direction of sensed movement;

determining when the car reaches a door zone; and applying a decelerating motor torque to slow movement of the car; and dropping the brake when the car stops or reaches a mid door zone position.

* * * * *